US011041349B2

(12) United States Patent
Fason et al.

(10) Patent No.: US 11,041,349 B2
(45) Date of Patent: Jun. 22, 2021

(54) AUTOMATIC SHIFT DETECTION FOR OIL AND GAS PRODUCTION SYSTEM

(71) Applicant: Schlumberger Technology Corporation, Sugar Land, TX (US)

(72) Inventors: James Fason, Houston, TX (US); Mohamed Elgindy, Algerie (DZ); Alexey Rusakov, Inverurie (GB); Hunter Wright, Houston, TX (US); Irving Lynch, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/158,236

(22) Filed: Oct. 11, 2018

(65) Prior Publication Data

US 2020/0115975 A1 Apr. 16, 2020

(51) Int. Cl.

| | |
|---|---|
| ***E21B 43/12*** | (2006.01) |
| ***E21B 21/08*** | (2006.01) |
| ***E21B 47/10*** | (2012.01) |
| ***E21B 47/008*** | (2012.01) |

(52) U.S. Cl.

CPC ..... *E21B 21/08* (2013.01); *E21B 43/126* (2013.01); *E21B 47/008* (2020.05); *E21B 47/10* (2013.01)

(58) Field of Classification Search

CPC ..... E21B 21/08; E21B 47/008; E21B 47/10; E21B 43/126

See application file for complete search history.

(56) References Cited

U.S. PATENT DOCUMENTS

| | | | |
|---|---|---|---|
| 4,741,208 | A | 5/1988 | Vandevier |
| 4,821,580 | A | 4/1989 | Jorritsma |
| 5,353,646 | A | 10/1994 | Kolpak |
| 5,466,127 | A | 11/1995 | Arnswald |
| 5,668,420 | A | 9/1997 | Lin et al. |
| 5,952,569 | A | 9/1999 | Jervis et al. |
| 7,117,120 | B2 | 10/2006 | Beck et al. |
| 7,258,164 | B2 | 8/2007 | Rezgui et al. |
| 7,562,723 | B2 | 7/2009 | Reitsma |
| 7,658,227 | B2 | 2/2010 | Fox et al. |
| 8,527,219 | B2 | 9/2013 | Camilleri |
| 9,476,742 | B2 | 10/2016 | Camilleri |
| 2002/0145423 | A1 | 10/2002 | Yoo |

(Continued)

FOREIGN PATENT DOCUMENTS

| | | | |
|---|---|---|---|
| RU | 2368772 | C1 | 9/2009 |
| WO | 2008/069695 | A2 | 6/2008 |

(Continued)

OTHER PUBLICATIONS

2007 ESP Workshop Agenda, ESP Workshop, Apr. 26, 2007, Woodland, TX USA.

(Continued)

*Primary Examiner* — Brad Harcourt

(74) *Attorney, Agent, or Firm* — Colin L. Wier

(57) ABSTRACT

A computer-implemented method and apparatus for monitoring an electric submersible pump and detecting a shift are disclosed. A leading and a lagging average over a predetermined period of time may be determined for a data stream obtained from an oil and gas production system, and a difference between the leading average and the lagging average may be used to detect a shift.

15 Claims, 7 Drawing Sheets

(56) References Cited

U.S. PATENT DOCUMENTS

| | | | | |
|---|---|---|---|---|
| 2004/0064292 | A1 | 4/2004 | Beck et al. | |
| 2005/0031443 | A1 | 2/2005 | Ohlsson et al. | |
| 2005/0216229 | A1 | 9/2005 | Huang et al. | |
| 2005/0217350 | A1* | 10/2005 | Jabusch | E21B 47/008 73/64.55 |
| 2006/0052903 | A1 | 3/2006 | Bassett | |
| 2006/0276999 | A1 | 12/2006 | Beck et al. | |
| 2007/0150113 | A1 | 6/2007 | Wang et al. | |
| 2007/0175633 | A1 | 8/2007 | Kosmala et al. | |
| 2007/0221173 | A1 | 9/2007 | Hazama | |
| 2007/0252717 | A1 | 11/2007 | Fielder | |
| 2008/0067116 | A1 | 3/2008 | Anderson et al. | |
| 2008/0260540 | A1 | 10/2008 | Koehl | |
| 2009/0000789 | A1 | 1/2009 | Leuthen et al. | |
| 2009/0044938 | A1 | 2/2009 | Crossley et al. | |
| 2009/0173166 | A1 | 7/2009 | Genosar | |
| 2009/0223662 | A1 | 9/2009 | Shaw et al. | |
| 2009/0250210 | A1 | 10/2009 | Allen et al. | |
| 2010/0206039 | A1 | 8/2010 | Kates | |
| 2010/0247335 | A1 | 9/2010 | Atherton | |
| 2011/0106452 | A1 | 5/2011 | Andrson et al. | |
| 2011/0168391 | A1 | 7/2011 | Saleri et al. | |
| 2013/0025940 | A1 | 1/2013 | Grimmer | |
| 2013/0090853 | A1 | 4/2013 | Anderson | |
| 2013/0204546 | A1 | 8/2013 | Devine et al. | |
| 2013/0327520 | A1* | 12/2013 | Hiroshi | G01F 1/007 166/250.03 |
| 2016/0265321 | A1 | 9/2016 | Elmer | |
| 2016/0281479 | A1 | 9/2016 | Rendusara et al. | |
| 2017/0363088 | A1 | 12/2017 | Nguyen et al. | |

FOREIGN PATENT DOCUMENTS

| | | | |
|---|---|---|---|
| WO | 2008/150811 | A1 | 12/2008 |
| WO | 2016/043866 | A1 | 3/2016 |
| WO | 2018/129349 | A1 | 7/2018 |

OTHER PUBLICATIONS

Bolin, Using the Calibrated-Tested Pumping Instrument (Electrical Submersible Pump) for Continuous Fluid Measurement When Producing Heavy Oil Wells, ESP Workshop, Apr. 26, 2007, The Woodland, TX, USA.

Camilleri, et aL., "First Installation of Five ESPs Offshore Romania—A Case Study and Lesson Learned," SPE127593, Intelligent Energy Conference and Exhibition held in Utrecht, The Netherlands, Mar. 23-25, 2010.

Camillery, et al., "First installation of Five ESPs Offshore Romania—A Case Study and Lesson Learned," Petrom_ESP, Apr. 29-May 1, 2009, pp. 1-22.

Olsen, et al., "Production Allocation Using ESP in the Peregrino Field," SPE Gulf Coast Section Electric Submersible Pump Workshop, The Woodlands, TX, Apr. 25-29, 2011.

Decision on grant for the cross referenced Russian patent application 2012120705 dated Nov. 21, 2013.

International Search Report and Written Opinion for the cross referenced International patent application PCT/US2014/065338, dated Mar. 31, 2015.

International Search Report and Written Opinion for the counterpart International patent application PCT/US2019/055017 dated Jan. 31, 2020.

Office Action Issued in related U.S Appl. No. 15/035,698 dated Dec. 31, 2018, 24 pages.

Johann Friedrich Gulich book "Centrifugal Pumps," Chapter 13.2 Pumping of gas-liquid mixtures, p. 753, Springer-Verlag Berlin Heidelberg New York, 2008, ISBN 978-3-540-73694-3.

International Search Report and Written Opinion dated Nov. 6, 2015 in PCT/US2015/044241.

International Preliminary Report on Patentability dated Mar. 30, 2017 in PCT/US2015/044241.

International Preliminary Report on Patentability dated May 17, 2016 in PCT/US2014/065338.

Examination Report under Section 18(3) dated Jul. 13, 2016 in Application No. GB1608333.9.

Patents Act 1977: Intention to Grant under Section 18(4) in Application No. GB1608333.9.

International Search Report and Written Opinion dated May 24, 2011 in PCT/US2010/053418.

International Preliminary Report on Patentability dated Apr. 24, 2012 in PCT/US2010/053418.

Decision of Grant dated Dec. 27, 2013 in Application No. 2012120705.

Patents Act 1977 Examination Report under Section 18(3) dated Oct. 3, 2014 in Application No. GB1208618.7.

Examination Report dated Aug. 3, 2014 in Application No. GC 2010-16928.

Notice of Publication & Grant Fees dated Apr. 13, 2015 in Application No. GC 2010-16928.

R. Beebe, "Use PdM to optimize pump overhauls," Hydrocarbon Processing, Apr. 2003, pp. 44-48.

David C. Gaiewski, "A Methodology for Determining Degraded Pump Performance Based on In-Service Test Criteria or Data," Downloaded from http://asmedigitalcollection.asme.org/POWER/proceedings-pdf/POWER2011/44601/255/2752481/255_1.pdf by Reprints Desk, Inc. user on 21 Dec. 2020, 5 pages.

Dholkawala et al., "From Operations to Desktop Analysis to Field Implementation: Well and ESP Optimization for Jroduction Enhancement in the Cliff Head Field," SPE Paper 128003, Feb. 2012 SPE Production & Operations, pp. 52-66.

International Preliminary Report on Patentability of International Application No. PCT/US2019/055017 dated Apr. 22, 2021, 8 pages.

* cited by examiner

AUTOMATIC SHIFT DETECTION FOR OIL AND GAS PRODUCTION SYSTEM

BACKGROUND

Oil and gas production systems often use artificial lift technologies, such as electric submersible pumps, to increase production. However, control over the flow rate within these pumps is often difficult due to the high pressures involved with these pumps. Furthermore, due to the lengths of the wellbores within which these pumps may be installed downhole, friction may need to be taken into consideration in order to achieve a single, accurate calibration over a wide range of flow rates.

Conventional methods for evaluating pump performance and controlling flow rates may be based on measuring flow rate and/or pump intake, discharge temperatures, and tubing pressure differentials. Such methods also necessitate manual detection of "shifts." A "shift" as referred to herein is a change in the "head" or tubing pressure difference (e.g., the difference between a downhole tube pressure and a top hole tube pressure). "Shifts" may occur for numerous reasons, including but not limited to, a pump being turned off, a calibration issue, a valve closure, a terminal failure, a calculation error, etc. Undetected shifts may be costly to overall production as they can result in downtime for a pump, and in some instances may even cause damage or failure of a pump.

SUMMARY

The embodiments disclosed herein provide a method, apparatus, and program product that monitor one or more pumps in an oil & gas production system to automatically detect, and in some instances, automatically address shifts. As described in greater detail herein, shifts are generally considered to be changes in tubing pressure difference (e.g. the difference between a downhole tube pressure and a top hole tube pressure).

Therefore, consistent with one aspect of the invention, a method for monitoring an electric submersible pump and detecting a shift is disclosed. The method include obtaining, from an oil and gas production system, a data stream; determining, by a processor, a leading and a lagging average over a predetermined period of time for the data stream; determining, by the processor, a difference between the leading average and the lagging average; detecting, by the processor, a shift where the difference between the leading average and the lagging average is greater than a predetermined threshold; sending, by the processor, a signal to the production system regarding the shift.

In some embodiments, the method additionally includes validating, by the processor, the detection of the shift. In some embodiments, the shift is validated where the difference between the leading average and the lagging average of at least one of a tubing head pressure, a drive frequency, or a volts/hertz is greater than the predetermined threshold at any point between a first state and a second state. In other embodiments, the shift is indicative of a pump off and is validated by movement from a stable state to an out of shift state.

In some embodiments, the method additionally includes reporting, by the processor, the detected shift to a user. In other embodiments, the method additionally includes determining, by the processor, an offset based on the difference between the leading average and the lagging average, and applying, by the processor, the offset to the data obtained from the pump.

In some embodiments, the data stream is at least one of: differential tubing pressure, drive frequency, tubing head pressure, or a volts to hertz ratio.

Consistent with another aspect of the invention, an apparatus is disclosed. The apparatus includes at least one processing unit; and program code configured upon execution by the at least one processing unit to monitor an electric submersible pump and detect a shift by: obtaining, from an oil and gas production system, a data stream; determining a leading and a lagging average over a predetermined period of time for the data stream; determining a difference between the leading average and the lagging average; detecting a shift where the difference between the leading average and the lagging average is greater than a predetermined threshold; sending a signal to the production system regarding the shift; and validating the detection of the shift.

In some embodiments, the shift is validated where the difference between the leading average and the lagging average of at least one of a tubing head pressure, a drive frequency, or a volts/hertz is greater than the predetermined threshold at any point between a first state and a second state. In other embodiments, the shift is indicative of a pump off and is validated by movement from a stable state to an out of shift state.

In some embodiments, the program code is further configured to report the detected shift to a user. In other embodiments, the program code is further configured by: determining an offset based on the difference between the leading average and the lagging average; and applying the offset to the data obtained from the electric submersible pump.

In some embodiments, the data stream is at least one of: differential tubing pressure, drive frequency, tubing head pressure, or a volts to hertz ratio.

Consistent with yet another aspect of the invention, a program product is disclosed. The program producing includes a computer readable medium; and program code stored on the computer readable medium and configured upon execution by at least one processing unit to perform electric submersible pump monitoring and shift detection by: obtaining, from an oil and gas production system, a data stream; determining a leading and a lagging average over a predetermined period of time for the data stream; determining a difference between the leading average and the lagging average; detecting a shift where the difference between the leading average and the lagging average is greater than a predetermined threshold; sending a signal to the production system regarding the shift; and validating the detection of the shift.

In some embodiments, the shift is validated where the difference between the leading average and the lagging average of at least one of a tubing head pressure, a drive frequency, or a volts/hertz is greater than the predetermined threshold at any point between a first state and a second state. In other embodiments, the shift is indicative of a pump off and is validated by movement from a stable state to an out of shift state.

In some embodiments, the program code is further configured to report the detected shift to a user. In other embodiments, the program code is further configured by: determining an offset based on the difference between the leading average and the lagging average; and applying the offset to the data obtained from the electric submersible pump.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

The herein-described embodiments provide a method, apparatus, and program product that monitor one or more pumps in an oil & gas production system to automatically detect, and in some instances, automatically address shifts, which are changes in tubing pressure difference (e.g. the difference between a downhole tube pressure and a top hole tube pressure) associated with pump frequency and/or tubing head pressure changes. In some embodiments, data from one or more data streams (e.g. a differential tubing pressure data steam, drive frequency data stream, tubing head pressure data stream, or a volts to hertz ratio data stream) may be obtained and analyzed, as described more fully herein, in order to detect a shift. Once detected the shift may be validated in various manners described herein. In addition, based on the shift detected, an offset may be calculated and applied to the data stream(s) to optimize functioning of the pump and production system.

Other variations and modifications will be apparent to one of ordinary skill in the art.

Hardware and Software Environment

Figure 1:
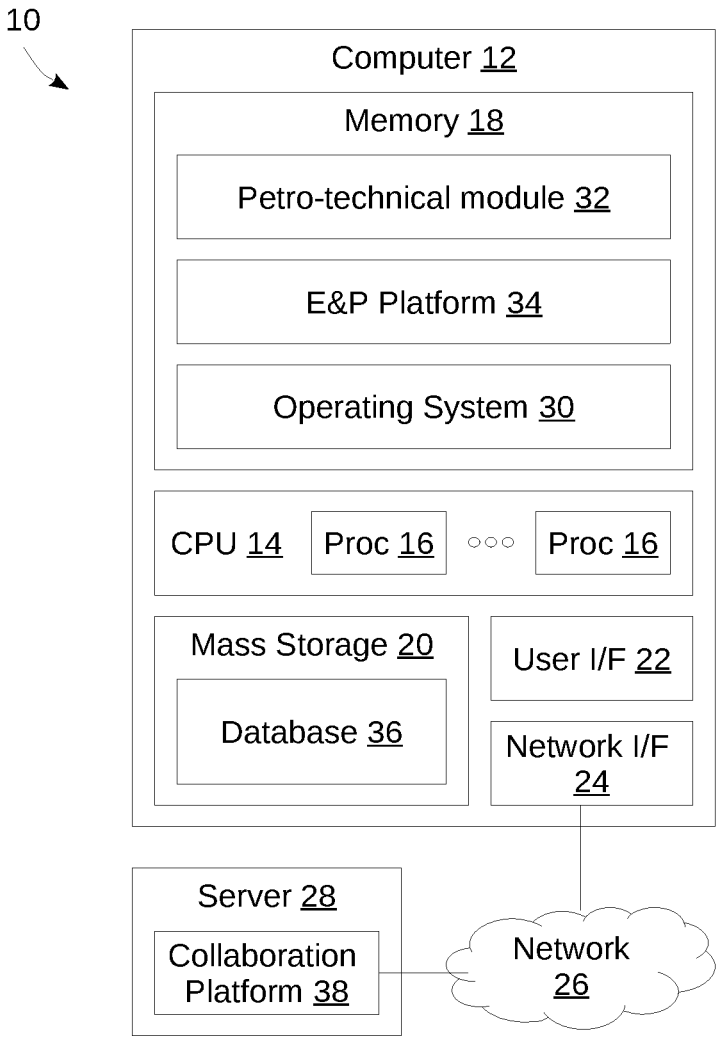
FIG. 1 is a block diagram of an example hardware and software environment for a data processing system in accordance with implementation of various technologies and techniques described herein.

Turning now to the drawings, wherein like numbers denote like parts throughout the several views, FIG. 1 illustrates an example data processing system 10 in which the various technologies and techniques described herein may be implemented. System 10 is illustrated as including one or more computers 12, e.g., client computers, each including a central processing unit (CPU) 14 including at least one hardware-based processor or processing core 16. CPU 14 is coupled to a memory 18, which may represent the random access memory (RAM) devices comprising the main storage of a computer 12, as well as any supplemental levels of memory, e.g., cache memories, non-volatile or backup memories (e.g., programmable or flash memories), read-only memories, etc. In addition, memory 18 may be considered to include memory storage physically located elsewhere in a computer 12, e.g., any cache memory in a microprocessor or processing core, as well as any storage capacity used as a virtual memory, e.g., as stored on a mass storage device 20 or on another computer coupled to a computer 12.

Each computer 12 also generally receives a number of inputs and outputs for communicating information externally. For interface with a user or operator, a computer 12 generally includes a user interface 22 incorporating one or more user input/output devices, e.g., a keyboard, a pointing device, a display, a printer, etc. Otherwise, user input may be received, e.g., over a network interface 24 coupled to a network 26, from one or more external computers, e.g., one or more servers 28 or other computers 12. A computer 12 also may be in communication with one or more mass storage devices 20, which may be, for example, internal hard disk storage devices, external hard disk storage devices, storage area network devices, etc.

A computer 12 generally operates under the control of an operating system 30 and executes or otherwise relies upon various computer software applications, components, programs, objects, modules, data structures, etc. For example, a petro-technical module or component 32 executing within an exploration and production (E&P) platform 34 may be used to access, process, generate, modify or otherwise utilize petro-technical data, e.g., as stored locally in a database 36 and/or accessible remotely from a collaboration platform 38. Collaboration platform 38 may be implemented using multiple servers 28 in some implementations, and it will be appreciated that each server 28 may incorporate a CPU, memory, and other hardware components similar to a computer 12.

In one non-limiting embodiment, for example, E&P platform 34 may implemented as the PETREL Exploration & Production (E&P) software platform, while collaboration platform 38 may be implemented as the STUDIO E&P KNOWLEDGE ENVIRONMENT platform, both of which are available from Schlumberger Ltd. and its affiliates. It will be appreciated, however, that the techniques discussed herein may be utilized in connection with other platforms and environments, so the invention is not limited to the particular software platforms and environments discussed herein.

It will be appreciated that the herein-described techniques may be implemented in a number of different computers, computer systems, devices, etc. In some embodiments, the herein-described techniques may be implemented within a production computer. In other embodiments, the implementation may be within an on-site computer at an oil field, within a pump itself (e.g. a smart pump), in a well or pump controller, in a cloud service, in a remote server, in another computer or electric device, or in various combinations thereof.

In general, the routines executed to implement the embodiments disclosed herein, whether implemented as part of an operating system or a specific application, component, program, object, module or sequence of instructions, or even a subset thereof, will be referred to herein as "computer program code," or simply "program code." Program code generally comprises one or more instructions that are resident at various times in various memory and storage devices in a computer, and that, when read and executed by one or more hardware-based processing units in a computer (e.g., microprocessors, processing cores, or other hardware-based circuit logic), cause that computer to perform the steps embodying desired functionality. Moreover, while embodiments have and hereinafter will be described in the context of fully functioning computers and computer systems, those skilled in the art will appreciate that the various embodiments are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, DVD, or other optical storage, magnetic cassettes, magnetic tape, magnetic disk storage or other magnetic storage devices, or any other medium that can be used to store the desired information and which can be accessed by computer 10. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

Furthermore, it will be appreciated by those of ordinary skill in the art having the benefit of the instant disclosure that the various operations described herein that may be performed by any program code, or performed in any routines, workflows, or the like, may be combined, split, reordered, omitted, and/or supplemented with other techniques known in the art, and therefore, the invention is not limited to the particular sequences of operations described herein.

Those skilled in the art will recognize that the example environment illustrated in FIG. 1 is not intended to limit the invention. Indeed, those skilled in the art will recognize that other alternative hardware and/or software environments may be used without departing from the scope of the invention.

Oilfield Operations

Figure 2A:
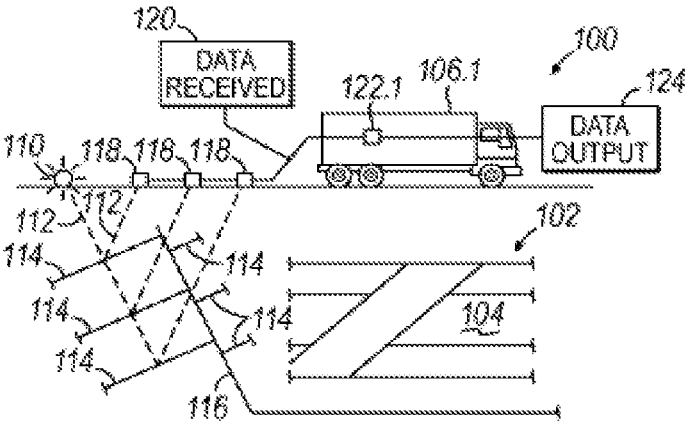
FIGS. 2A-2D illustrate simplified, schematic views of an oilfield having subterranean formations containing reservoirs therein in accordance with implementations of various technologies and techniques described herein.

FIGS. 2A-2D illustrate simplified, schematic views of an oilfield 100 having subterranean formation 102 containing reservoir 104 therein in accordance with implementations of various technologies and techniques described herein. FIG. 2A illustrates a survey operation being performed by a survey tool, such as seismic truck 106.1, to measure properties of the subterranean formation. The survey operation is a seismic survey operation for producing sound vibrations. In FIG. 2A, one such sound vibration, sound vibration 112 generated by source 110, reflects off horizons 114 in earth formation 116. A set of sound vibrations is received by sensors, such as geophone-receivers 118, situated on the earth's surface. The data received 120 is provided as input data to a computer 122.1 of a seismic truck 106.1, and responsive to the input data, computer 122.1 generates seismic data output 124. This seismic data output may be stored, transmitted or further processed as desired, for example, by data reduction.

Figure 2B:
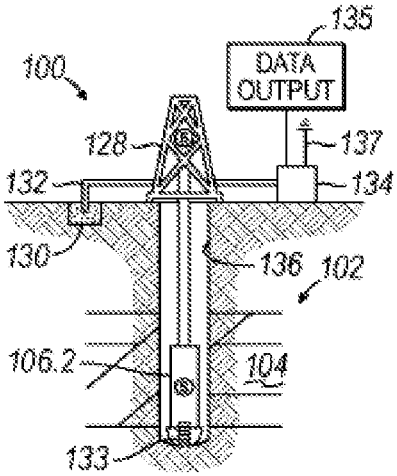

FIG. 2B illustrates a drilling operation being performed by drilling tools 106.2 suspended by rig 128 and advanced into subterranean formations 102 to form wellbore 136. Mud pit 130 is used to draw drilling mud into the drilling tools via flow line 132 for circulating drilling mud down through the drilling tools, then up wellbore 136 and back to the surface. The drilling mud may be filtered and returned to the mud pit. A circulating system may be used for storing, controlling, or filtering the flowing drilling muds. The drilling tools are advanced into subterranean formations 102 to reach reservoir 104. Each well may target one or more reservoirs. The drilling tools are adapted for measuring downhole properties using logging while drilling tools. The logging while drilling tools may also be adapted for taking core sample 133 as shown.

Computer facilities may be positioned at various locations about the oilfield 100 (e.g., the surface unit 134) and/or at remote locations. Surface unit 134 may be used to communicate with the drilling tools and/or offsite operations, as well as with other surface or downhole sensors. Surface unit 134 is capable of communicating with the drilling tools to send commands to the drilling tools, and to receive data therefrom. Surface unit 134 may also collect data generated during the drilling operation and produces data output 135, which may then be stored or transmitted.

Sensors (S), such as gauges, may be positioned about oilfield 100 to collect data relating to various oilfield operations as described previously. As shown, sensor (S) is positioned in one or more locations in the drilling tools and/or at rig 128 to measure drilling parameters, such as weight on bit, torque on bit, pressures, temperatures, flow rates, compositions, rotary speed, and/or other parameters of the field operation. Sensors (S) may also be positioned in one or more locations in the circulating system.

Drilling tools 106.2 may include a bottom hole assembly (BHA) (not shown), generally referenced, near the drill bit (e.g., within several drill collar lengths from the drill bit). The bottom hole assembly includes capabilities for measuring, processing, and storing information, as well as communicating with surface unit 134. The bottom hole assembly further includes drill collars for performing various other measurement functions.

The bottom hole assembly may include a communication subassembly that communicates with surface unit 134. The communication subassembly is adapted to send signals to and receive signals from the surface using a communications channel such as mud pulse telemetry, electro-magnetic telemetry, or wired drill pipe communications. The communication subassembly may include, for example, a transmitter that generates a signal, such as an acoustic or electromagnetic signal, which is representative of the measured drilling parameters. It will be appreciated by one of skill in the art that a variety of telemetry systems may be employed, such as wired drill pipe, electromagnetic or other known telemetry systems.

Generally, the wellbore is drilled according to a drilling plan that is established prior to drilling. The drilling plan sets forth equipment, pressures, trajectories and/or other parameters that define the drilling process for the wellsite. The drilling operation may then be performed according to the drilling plan. However, as information is gathered, the drilling operation may need to deviate from the drilling plan. Additionally, as drilling or other operations are performed, the subsurface conditions may change. The earth model may also need adjustment as new information is collected.

The data gathered by sensors (S) may be collected by surface unit 134 and/or other data collection sources for analysis or other processing. The data collected by sensors (S) may be used alone or in combination with other data. The data may be collected in one or more databases and/or transmitted on or offsite. The data may be historical data, real time data, or combinations thereof. The real time data may be used in real time, or stored for later use. The data may also be combined with historical data or other inputs for further analysis. The data may be stored in separate databases, or combined into a single database.

Surface unit 134 may include transceiver 137 to allow communications between surface unit 134 and various portions of the oilfield 100 or other locations. Surface unit 134 may also be provided with or functionally connected to one or more controllers (not shown) for actuating mechanisms at oilfield 100. Surface unit 134 may then send command signals to oilfield 100 in response to data received. Surface unit 134 may receive commands via transceiver 137 or may itself execute commands to the controller. A processor may be provided to analyze the data (locally or remotely), make the decisions and/or actuate the controller. In this manner, oilfield 100 may be selectively adjusted based on the data collected. This technique may be used to optimize portions of the field operation, such as controlling drilling, weight on bit, pump rates, or other parameters. These adjustments may be made automatically based on computer protocol, and/or manually by an operator. In some cases, well plans may be adjusted to select optimum operating conditions, or to avoid problems.

Figure 2C:
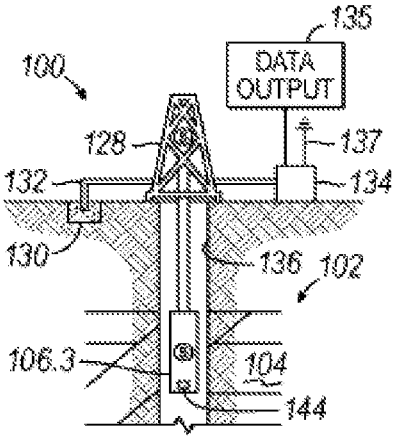

FIG. 2C illustrates a wireline operation being performed by wireline tool 106.3 suspended by rig 128 and into wellbore 136 of FIG. 2B. Wireline tool 106.3 is adapted for deployment into wellbore 136 for generating well logs, performing downhole tests and/or collecting samples. Wireline tool 106.3 may be used to provide another method and apparatus for performing a seismic survey operation. Wireline tool 106.3 may, for example, have an explosive, radioactive, electrical, or acoustic energy source 144 that sends and/or receives electrical signals to surrounding subterranean formations 102 and fluids therein.

Wireline tool 106.3 may be operatively connected to, for example, geophones 118 and a computer 122.1 of a seismic truck 106.1 of FIG. 2A. Wireline tool 106.3 may also provide data to surface unit 134. Surface unit 134 may collect data generated during the wireline operation and may produce data output 135 that may be stored or transmitted. Wireline tool 106.3 may be positioned at various depths in the wellbore 136 to provide a survey or other information relating to the subterranean formation 102.

Sensors (S), such as gauges, may be positioned about oilfield 100 to collect data relating to various field operations as described previously. As shown, sensor S is positioned in wireline tool 106.3 to measure downhole parameters which relate to, for example porosity, permeability, fluid composition and/or other parameters of the field operation.

Figure 2D:
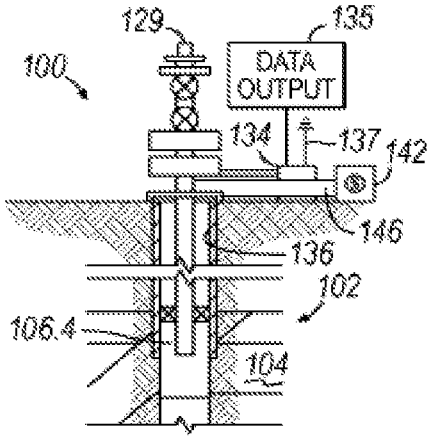

FIG. 2D illustrates a production operation being performed by production tool 106.4 deployed from a production unit or Christmas tree 129 and into completed wellbore 136 for drawing fluid from the downhole reservoirs into surface facilities 142. The fluid flows from reservoir 104 through perforations in the casing (not shown) and into production tool 106.4 in wellbore 136 and to surface facilities 142 via gathering network 146.

Sensors (S), such as gauges, may be positioned about oilfield 100 to collect data relating to various field operations as described previously. As shown, the sensor (S) may be positioned in production tool 106.4 or associated equipment, such as christmas tree 129, gathering network 146, surface facility 142, and/or the production facility, to measure fluid parameters, such as fluid composition, flow rates, pressures, temperatures, and/or other parameters of the production operation.

Production may also include injection wells for added recovery. One or more gathering facilities may be operatively connected to one or more of the wellsites for selectively collecting downhole fluids from the wellsite(s).

While FIGS. 2B-2D illustrate tools used to measure properties of an oilfield, it will be appreciated that the tools may be used in connection with non-oilfield operations, such as gas fields, mines, aquifers, storage, or other subterranean facilities. Also, while certain data acquisition tools are depicted, it will be appreciated that various measurement tools capable of sensing parameters, such as seismic two-way travel time, density, resistivity, production rate, etc., of the subterranean formation and/or its geological formations may be used. Various sensors (S) may be located at various positions along the wellbore and/or the monitoring tools to collect and/or monitor the desired data. Other sources of data may also be provided from offsite locations.

The field configurations of FIGS. 2A-2D are intended to provide a brief description of an example of a field usable with oilfield application frameworks. Part, or all, of oilfield 100 may be on land, water, and/or sea. Also, while a single field measured at a single location is depicted, oilfield applications may be utilized with any combination of one or more oilfields, one or more processing facilities and one or more wellsites.

Figure 3:
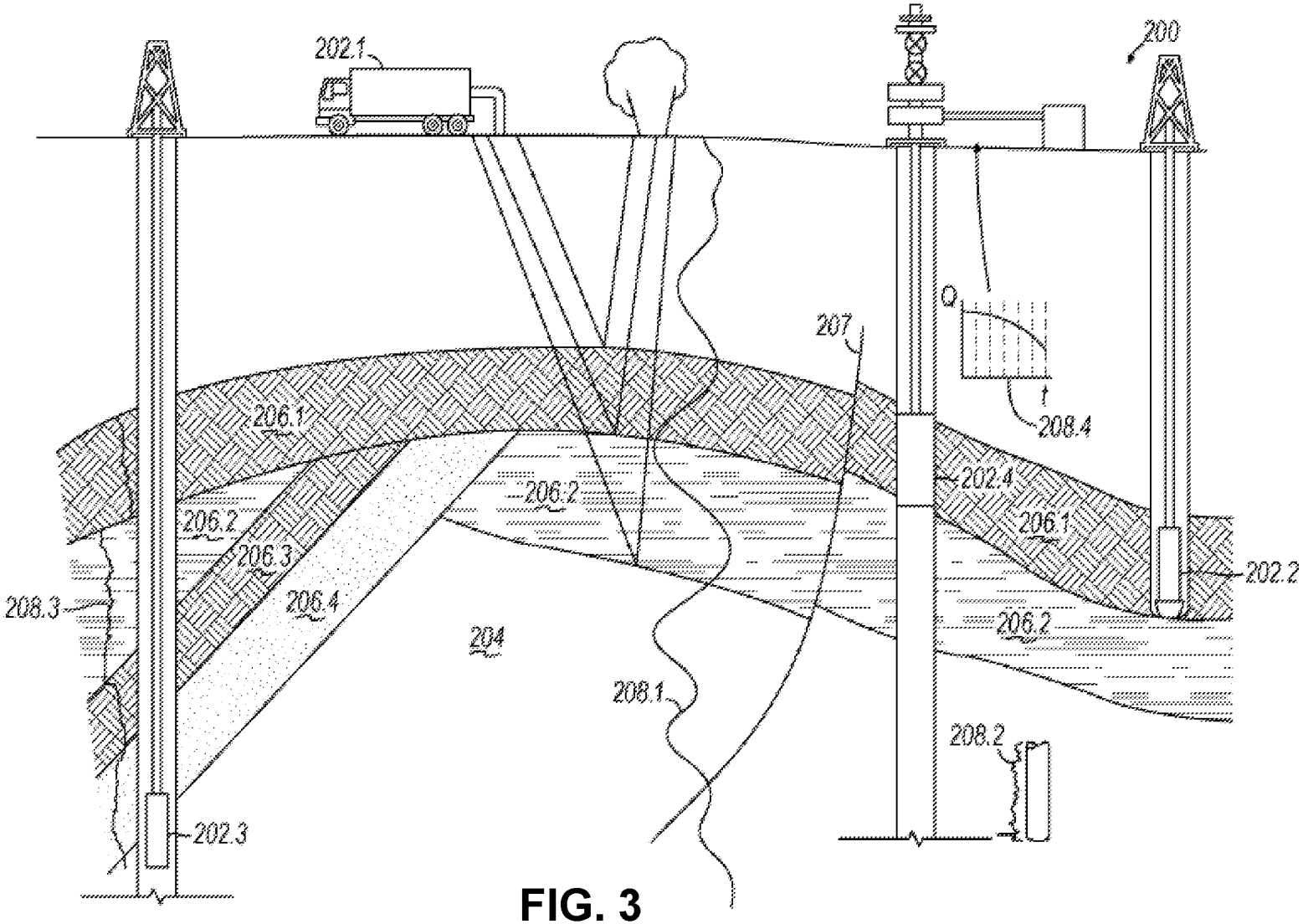
FIG. 3 illustrates a schematic view, partially in cross section of an oilfield having a plurality of data acquisition tools positioned at various locations along the oilfield for collecting data from the subterranean formations in accordance with implementations of various technologies and techniques described herein.

FIG. 3 illustrates a schematic view, partially in cross section of oilfield 200 having data acquisition tools 202.1, 202.2, 202.3 and 202.4 positioned at various locations along oilfield 200 for collecting data of subterranean formation 204 in accordance with implementations of various technologies and techniques described herein. Data acquisition tools 202.1-202.4 may be the same as data acquisition tools 106.1-106.4 of FIGS. 2A-2D, respectively, or others not depicted. As shown, data acquisition tools 202.1-202.4 generate data plots or measurements 208.1-208.4, respectively. These data plots are depicted along oilfield 200 to demonstrate the data generated by the various operations.

Data plots 208.1-208.3 are examples of static data plots that may be generated by data acquisition tools 202.1-202.3, respectively, however, it should be understood that data plots 208.1-208.3 may also be data plots that are updated in real time. These measurements may be analyzed to better define the properties of the formation(s) and/or determine the accuracy of the measurements and/or for checking for errors. The plots of each of the respective measurements may be aligned and scaled for comparison and verification of the properties.

Static data plot 208.1 is a seismic two-way response over a period of time. Static plot 208.2 is core sample data measured from a core sample of the formation 204. The core sample may be used to provide data, such as a graph of the density, porosity, permeability, or some other physical property of the core sample over the length of the core. Tests for density and viscosity may be performed on the fluids in the core at varying pressures and temperatures. Static data plot 208.3 is a logging trace that generally provides a resistivity or other measurement of the formation at various depths.

A production decline curve or graph 208.4 is a dynamic data plot of the fluid flow rate over time. The production decline curve generally provides the production rate as a function of time. As the fluid flows through the wellbore, measurements are taken of fluid properties, such as flow rates, pressures, composition, etc.

Other data may also be collected, such as historical data, user inputs, economic information, and/or other measurement data and other parameters of interest. As described below, the static and dynamic measurements may be analyzed and used to generate models of the subterranean formation to determine characteristics thereof. Similar measurements may also be used to measure changes in formation aspects over time.

The subterranean structure 204 has a plurality of geological formations 206.1-206.4. As shown, this structure has several formations or layers, including a shale layer 206.1, a carbonate layer 206.2, a shale layer 206.3 and a sand layer 206.4. A fault 207 extends through the shale layer 206.1 and the carbonate layer 206.2. The static data acquisition tools are adapted to take measurements and detect characteristics of the formations.

While a specific subterranean formation with specific geological structures is depicted, it will be appreciated that oilfield 200 may contain a variety of geological structures and/or formations, sometimes having extreme complexity. In some locations, generally below the water line, fluid may occupy pore spaces of the formations. Each of the measurement devices may be used to measure properties of the formations and/or its geological features. While each acquisition tool is shown as being in specific locations in oilfield 200, it will be appreciated that one or more types of measurement may be taken at one or more locations across one or more fields or other locations for comparison and/or analysis.

The data collected from various sources, such as the data acquisition tools of FIG. 3, may then be processed and/or evaluated. Generally, seismic data displayed in static data plot 208.1 from data acquisition tool 202.1 is used by a geophysicist to determine characteristics of the subterranean formations and features. The core data shown in static plot 208.2 and/or log data from well log 208.3 are generally used by a geologist to determine various characteristics of the subterranean formation. The production data from graph 208.4 is generally used by the reservoir engineer to determine fluid flow reservoir characteristics. The data analyzed by the geologist, geophysicist and the reservoir engineer may be analyzed using modeling techniques.

Figure 4:
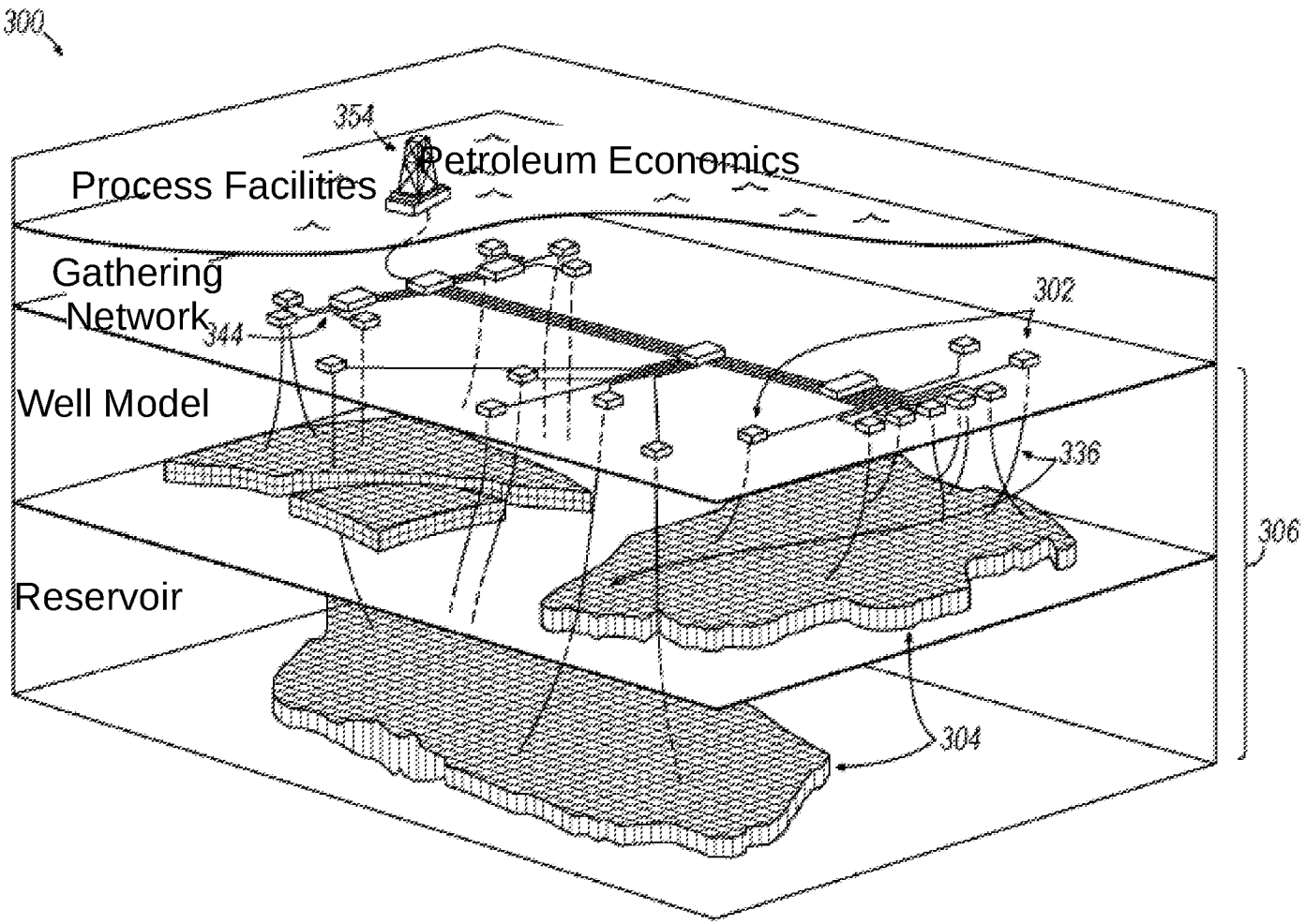
FIG. 4 illustrates a production system for performing one or more oilfield operations in accordance with implementations of various technologies and techniques described herein.

FIG. 4 illustrates an oilfield 300 for performing production operations in accordance with implementations of various technologies and techniques described herein. As shown, the oilfield has a plurality of wellsites 302 operatively connected to central processing facility 354. The oilfield configuration of FIG. 4 is not intended to limit the scope of the oilfield application system. Part or all of the oilfield may be on land and/or sea. Also, while a single oilfield with a single processing facility and a plurality of wellsites is depicted, any combination of one or more oilfields, one or more processing facilities and one or more wellsites may be present.

Each wellsite 302 has equipment that forms wellbore 336 into the earth. The wellbores extend through subterranean formations 306 including reservoirs 304. These reservoirs 304 contain fluids, such as hydrocarbons. The wellsites draw fluid from the reservoirs and pass them to the processing facilities via surface networks 344. The surface networks 344 have tubing and control mechanisms for controlling the flow of fluids from the wellsite to processing facility 354.

Automatic Shift Detection

As previously mentioned, a "shift" as used herein is a change in tubing pressure difference (e.g. the difference between a downhole tube pressure and a top hole tube pressure). Functionally, a shift occurs when the data received by the production system is not accurately reflecting what is happening in the well. "Shifts" may occur for numerous reasons, including but not limited to, a pump being (in some instances unexpectedly) turned off, a calibration issue, a valve closure, a terminal failure, a calculation error, etc.

As such, a shift may be costly to overall production as it can result in downtime for the pump, and in some instances may even cause complete failure or destruction of the pump. For example, some pumps may include electronics to increase the number of rotations per minute in order to maintain a stable production based on data collected about the well. Where there is a data indicated change in circumstances these electronics may signal to the pump to increase the pump speed to maintain a stable production level. However, where that data does not correspond to the actual status of the well (e.g. a shift has occurred) the pump may have unnecessarily increased its speed. Such an unnecessary increase may lower the time to pump failure by adding unnecessary stress to the various mechanical components (e.g. the bearings, propeller(s), impeller(s), and/or the like). Therefore, it is desirable to detect shifts and mitigate them so the production system may continue to function optimally. A controller, such as described herein, may be programmed to look for certain event signatures (described in detail herein) that are associated with shifts. The occurrence of certain events may be mitigated by automatically adjusting operation of a well system according to suitable protocols for a given event, such as, for example, applying an offset value to the data to correct the data to more accurately reflect well conditions. Certain embodiments described herein utilize signal processing combined with information from the well and equipment to detect shifts.

The described method of shift detection and determination of water content is based on determining the average mixture density in the production tubing above the electric submersible pump as a function of the pressure difference between the pump discharge (the top hole) and wellhead (the downhole). Given the length of the tubing, due to the long distances between the wellhead and pump discharge sites, friction generally must be taken into consideration in order to achieve a single calibration over a wide range of flow rates. In environments where the average holdup change is small, the change in density can be related to a water cut change calculated using Equation 1.

$$WC = \frac{\rho_{liquid} - \rho_o}{\rho_w - \rho_o} \quad \text{Equation (1)}$$

Where WC is water cut, $P_{liquid}$ is the pressure measurement for all liquid, $P_o$ is the pressure measurement for the oil fraction, and $P_w$ is the pressure measurement for the water fraction.

The general equation relating the tubing pressure difference between the pump discharge (the top hole) and wellhead (the downhole) to the liquid density is shown in Equation 2 below. Equation 2 requires knowledge of the holdup ($H_L$), which is typically obtained by calibrating with a physical measurement of water cut.

$$\frac{Pd - Pth}{gh} = \rho_{liquid} \times H_L + \rho_{gas} \times (1 - H_L) + \text{friction} \quad \text{Equation (2)}$$

Where, gh is the Earth's gravity, $P_{liquid}$ is the pressure measurement for all liquid, and $P_{gas}$ is the pressure measurement for the gas faction.

Figure 5:
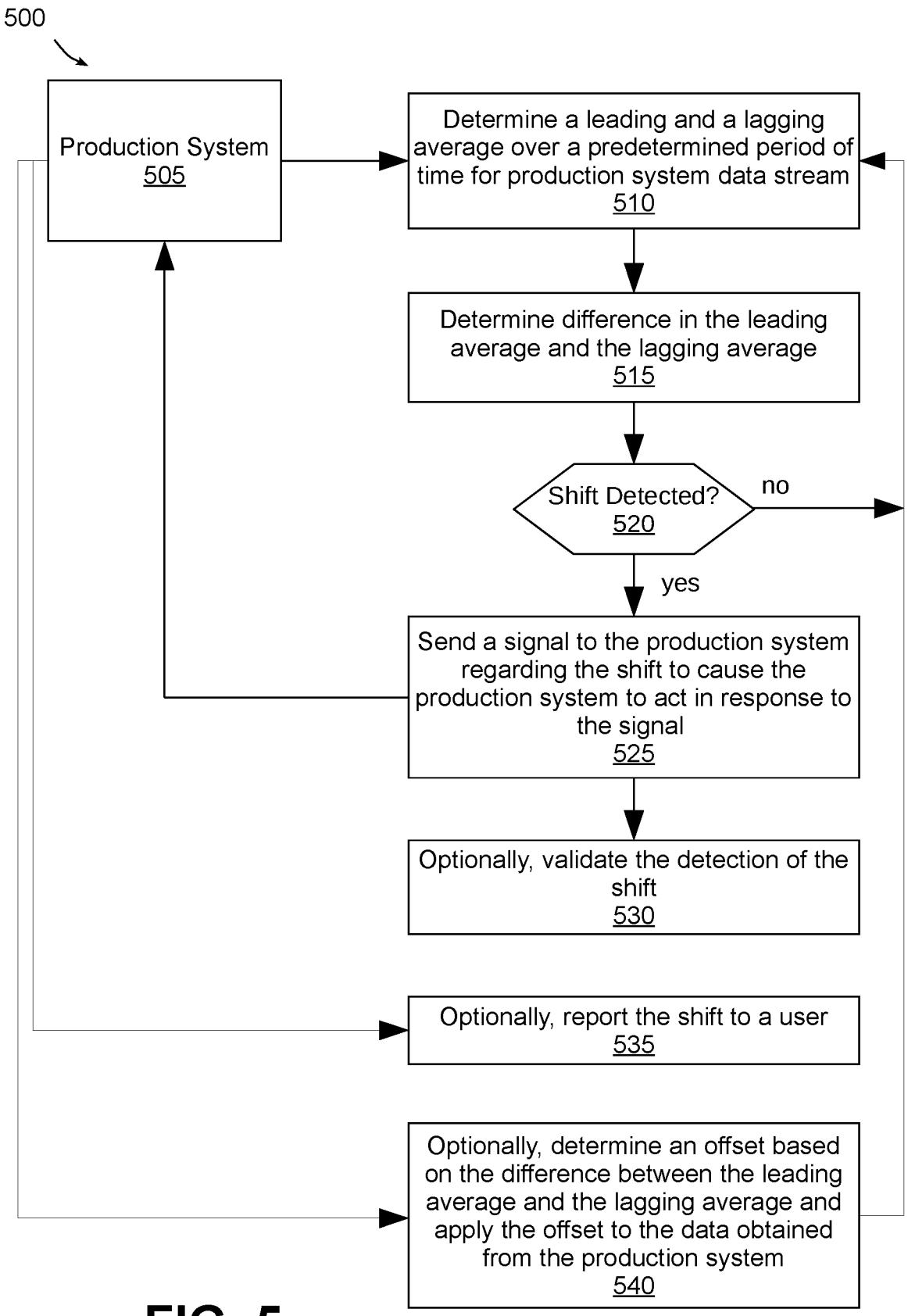
FIG. 5 is a flowchart illustrating an example sequence of operations for monitoring a pump and detecting and addressing a shift using the data processing system of FIG. 1.

FIG. 5 illustrates a flowchart of an example sequence of operations for monitoring a pump and detecting a shift using the data processing system of FIG. 1. A production system 505 may provide one or more data streams. In some instances, production system 505 may include a signal processing unit that obtains historical data and current operating conditions, pump details, and other data useful for analysis. These data streams from the various downhole sensors may be conveyed to the control and monitoring equipment via a suitable communication line, such as, but not limited to a downhole wireline or various wireless technologies. In some embodiments, the data streams may include, but is not limited to, differential tubing pressure data, drive frequency data, tubing head pressure data, and/or volts/hertz ratio data.

Figure 7A:
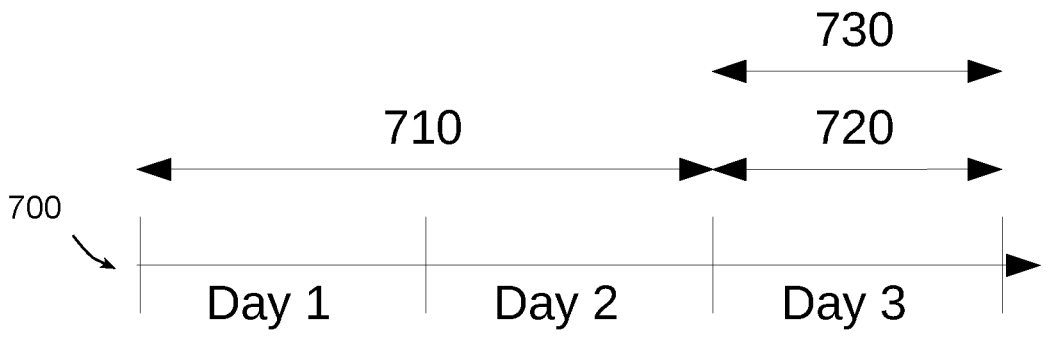
FIG. 7A is an example timeline for calculating a leading and a lagging average over a configurable window of time in accordance with implementations of various technologies and techniques described herein.
Figure 7B:
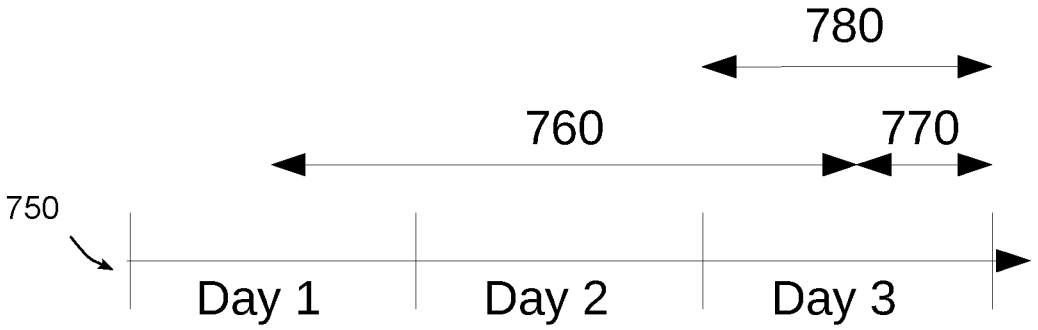
FIG. 7B is another example timeline for calculating a leading and a lagging average over a configurable window of time in accordance with implementations of various technologies and techniques described herein.

At block 510 two rolling averages may be determined for each data stream. Each rolling average may calculated over a configurable window of time, examples of which are illustrated in FIGS. 7A and 7B. These windows may be defined using three timespan parameters per channel: 1) a leading timespan 730, 780; 2) a step timespan 720, 770; and 3) a lagging timespan 710, 760. FIG. 7A illustrates an example timeline 700 for tubing head pressure (THP) shifting properties based on Table 1; while FIG. 7B illustrates another example timeline 750 for tubing head pressure (THP) shifting properties based on Table 2.

TABLE 1

| Timespan | Value (in days) |
|---|---|
| THP Lagging Timespan | 2 |
| THP Leading Timespan | 1 |
| THP Step Timespan | 1 |

TABLE 2

| Timespan | Value (in days) |
|---|---|
| THP Lagging Timespan | 2 |
| THP Leading Timespan | 1 |
| THP Step Timespan | 0.5 |

The first rolling average is a "leading average", which may be calculated over data from the current time minus the leading timespan 730, 780 to the current time. The second rolling average is a "lagging average", which may be calculated over data from the current time minus the step timespan 720, 770 minus the lagging timespan 710, 760 to the current time minus step-timespan 720, 770.

Returning now to FIG. 5, at block 515, a difference between the rolling leading average and the rolling lagging average may be determined. At block 520, a shift may be detected where the difference between the leading average and the lagging average is greater than a predetermined threshold value. In addition, in some embodiments, once detected, a shift may be classified into one of a plurality of types. In some embodiments, for example, a shift may be classified into one of two types: 1) a regular shift, and 2) a pump off shift. In some embodiments, a regular shift may be triggered by the difference in the leading and lagging tubing pressure differential averages being over the tubing pressure differential threshold. In other embodiments, a regular shift may be detected by the difference in the leading and lagging drive frequency averages being over the drive frequency threshold. In still other embodiments, a regular shift may be detected by the difference in the leading and lagging tubing head pressure averages being over the tubing head pressure threshold. In still yet other embodiments, a regular shift may be detected by the difference in the leading and lagging volts to hertz ratio averages being over the volts to hertz ratio threshold. A pump off shift may be detected when the pump is detected as being off. In some embodiments, a pump off may be detected by examining a combination of various data streams. For example, in some instances a pump off may be detected where the difference in the leading and lagging averages for current, frequency, and voltage are each below a predetermined minimum threshold. In other embodiments, a pump off may be detected where the difference in the leading and lagging averages for the differential pump pressure is less than a predetermined minimum and the leading and lagging averages for current is also below a predetermined minimum.

In some instances, it may be desirable to validate the detection of a shift, for example at optional block 530. The process for validating a shift may depend on whether the shift is a regular shift or a pump off shift. For example, where the detected shift is a regular shift, the shift may be considered valid if any of the differences between the leading and lagging averages of the of tubing head pressure, drive frequency, or volts to hertz ratio go above their respective predetermined thresholds at any point between the in shift unstable state and the out of shift pump state. As an additional example, where the shift is a pump off shift, the shift may be considered validated where the state moves from an in shift stable state to an out of shift stable state.

Once detected, at block 525, a signal regarding the shift may be sent to the production system, which may then act in response to the signal. In some embodiments, this action may include reporting the detected shift to user, at optional block 535. In other embodiments, this action may include determining an offset based on the shift (optional block 540) and applying that offset to the data obtained from the production system.

In some embodiments, which may be referred to herein as "detected shifts", a shift may be detected but there may not be enough data to apply that shift. In such instances, these detected shifts may be reported to a user, for example an engineer, so that the user may take appropriate action. For example, one or more of these detected shifts may be reported in a daily report that details various information regarding pump performance. Such daily reports may include information regarding a series of quality flags to provide insights into pump performance. In some embodiments, these flags are grouped by category (e.g. motor flags, water cut flags) and may display a value for each flag, the aggregation for the group, and an aggregate for the pump Detected shifts, and a user's analysis thereof, may be important to the overall operation of the pump and production system as they may help limit the excessive starting and stopping of the pump due to false shifts. In some embodiments, a user upon review of the detected shifts and may choose to alter to the shift settings to improve accuracy of shift detection.

In other embodiments, which may be referred to as "applied shifts", there may be a manual shift setting, that functions similarly to the detected shift described above, and an automatic shift setting, which automatically detects a shift and acts accordingly (e.g. by applying an offset). Where the automatic shift setting is turned off, it functions manually.

In embodiments where a well or pump has a production history, the production history and/or the well behavior may be observed to determine the accuracy of the automatic shift detection. In embodiments where a well or pump does not have a production history, a user may observe the well behavior and test the function and accuracy of the automatic shift setting prior to activating the automatic shift setting. During the initial manual phase, the detection of shifts and reporting the same may critical to efficiently operating the pump and production system. Where a manually determined shift has a timestamp of less than "now" (or the current time) and the automatic shift setting is turned on, then the offset may be determined by the automatic shift and may be applied to the automatic shift. However, where there is a manual shift in the data stream with a timestamp in the future, automatic shifts may be ignored. A timestamp in the future may, for example, occur when a user enters the shift into the system.

Regardless of whether the shift is a "detected shift" or an "applied shift" the failure to detect the shift could be costly to overall production due to pump downtime, pump damage, or in some instances may even cause complete pump failure. Therefore, it is desirable in many instances to accurately detect shifts and mitigate them, for example through application of an offset, so the production system may continue to function optimally.

However, the detection of false shifts, which may result in unnecessary downtime or overcorrection, may also be undesirable. Therefore, in some embodiments, certain safeguards may be added to prevent false shifts from being detected. As a non-limiting example for tubing head pressure and drive frequency data, once a shift is entered and detected, the current lagging average for both the tubing head pressure and the drive frequency may be saved. When new values are received, the current leading average for the tubing head pressure may be compared to the saved lagging average for the tubing head pressure. If this difference is greater than the predetermined threshold for the tubing head pressure the shift is labeled as valid and the water cut (WC) and pump health indicator (PHI) are turned off until the completion of the shift. This same process may be repeated with the drive frequency data. If a shift ends and has not been flagged because either the tubing head pressure difference or the drive frequency difference have surpassed their respective predetermined thresholds then the shift may be determined to be an invalid shift. In some embodiments, for example where the leading average for the drive frequency or the tubing head pressure is different from the saved drive frequency average or the tubing head pressure average the shift may be considered valid; in some instances, this may even include when the difference later falls back below the predetermined threshold before the shift ends. However, in other embodiments, this functionality may be disabled.

Figure 6:
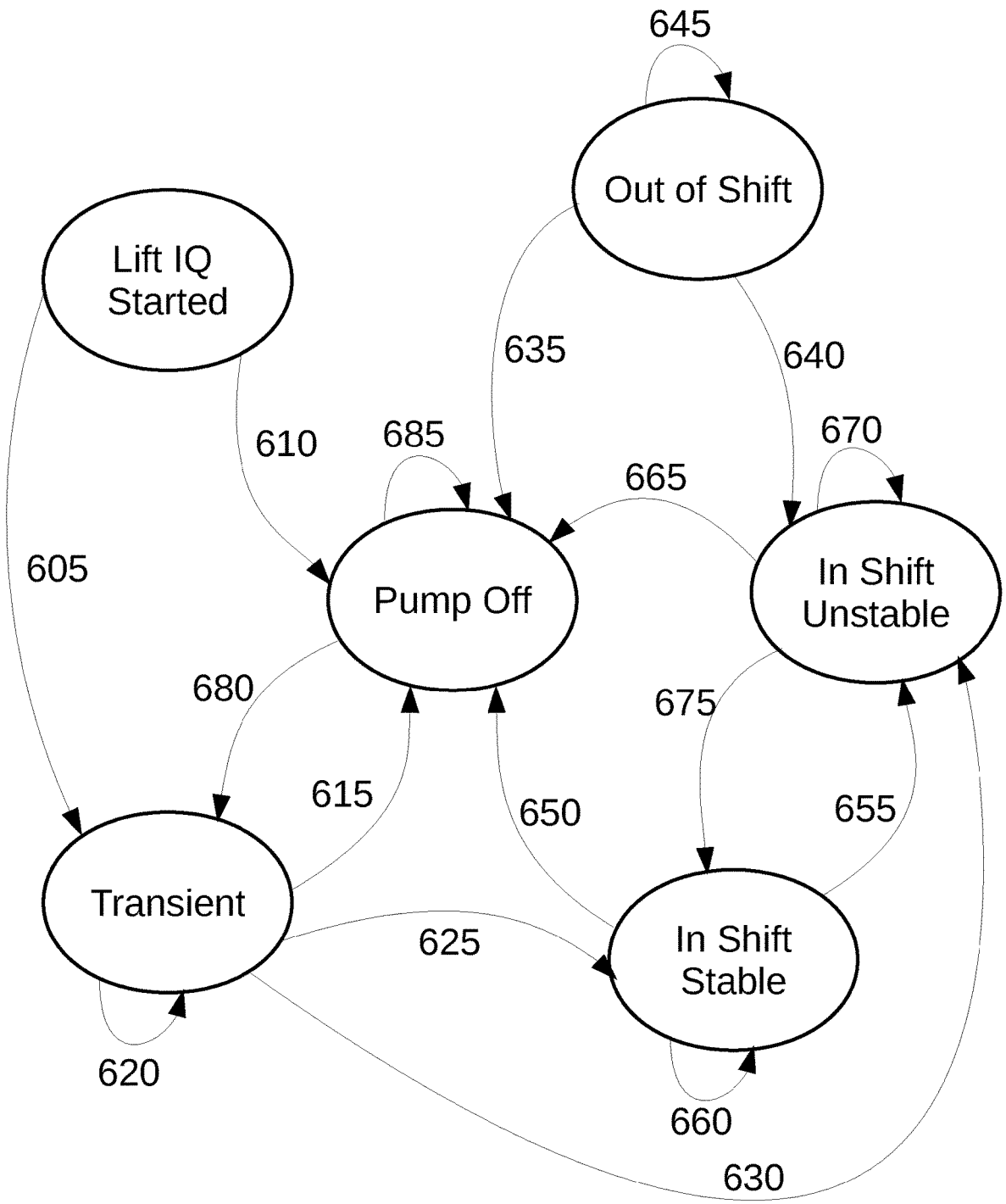
FIG. 6 is an example state diagram for a pump state machine in accordance with implementations of various technologies and techniques described herein.

FIG. 6 illustrates an example state diagram for a pump state machine for use in evaluating shifts. A state machine provides a transition or next state function when transitioning between a first state and a second state, while a state diagram illustrates these transitions between states. In some embodiments, the state machine may run on a well or pump controller of the production system. In other embodiments, the state machine may run on a non-site computer (which may be a part of the production system) at an oil field. The entire monitoring and detection of shift process may begin with starting a life-cycle management system, for example on a pump controller, for example the Lift IQ available from Schlumberger Ltd. and its affiliates. A life cycle management system may provide real-time analytics and optimization, at the level of a single well to an entire field.

The state diagram of FIG. 6 starts with the beginning of a data set for a data stream; it is at this point the life-cycle management system (e.g. Lift 10) may be started. In the exemplary embodiment of FIG. 6, a transition 605 from the starting of the Lift IQ life-cycle management system to a pump off state (e.g. where the pump is off entirely) starts a shift. Transition 610 from the starting of the Lift IQ life-cycle management system to a transient state starts a transience timer, which is a timestamp for the beginning of the transition from a first state to a second state.

Transition 615 between the transient state to a pump off state requires no action. Transition 620 illustrates remaining in the transient state. Transition 625 between the transient state and an in shift stable state saves the stabilization time, which is the timestamp for the most recent stable state. The in shift stable state is when the well has recently shifted, but the shift has not yet stabilized. The shift may be considered stabilized when the difference in the leading and lagging averages for the data streams being used (e.g. differential tubing pressure) is less than a predetermined threshold. In contrast, the in shift unstable state may be when the well is currently shifting, meaning the difference in the leading and lagging averages for the data streams being used may be greater than a predetermined threshold. The out of shift state is when the well is not shifting, meaning the difference in the leading and lagging averages for the data streams is below a predetermined threshold. Transition 630 between the transient state and an in shift unstable state starts a shift.

Transition 635 between the out of shift state and the pump off state starts a shift. Transition 640 between the out of shift state and the in shift unstable state also starts a shift. Finally, transition 645 illustrates remaining in the out of shift state.

Transition 650 between the in shift stable state and the pump off state starts a shift. Similarly, transition 655 between the in shift stable state and the in shift unstable state starts a shift. Transition 660 illustrates remaining in the in shift stable state, which includes calculating the shift and appropriate next steps (e.g. an offset) as described previously herein.

Transition 665 between the in shift unstable state and the pump off state starts a shift. Similarly, transition 670 illustrates remaining in the in shift unstable state, which also starts a shift. Transition 675 between the in shift unstable state to the in shift stable state saves a stabilization time to the system memory may be utilized the next time a shift is detected.

The pump off state, as mentioned previously, occurs when the pump is not operating. Transition 680 between the pump off state and the transient state saves the stabilization time. Transition 685 illustrates remaining in the pump off state.

While particular embodiments have been described, it is not intended that the invention be limited thereto, as it is intended that the invention be as broad in scope as the art will allow and that the specification be read likewise. It will therefore be appreciated by those skilled in the art that yet other modifications could be made without deviating from its spirit and scope as claimed.

What is claimed is:

1. A computer-implemented method for monitoring an electric submersible pump and detecting a shift, the method comprising:

obtaining, from an oil and gas production system, a data stream;

determining, by a processor, a leading and a lagging average over a predetermined period of time for the data stream;

determining, by the processor, a difference between the leading average and the lagging average;

determining, by the processor, an offset based on the difference between the leading average and the lagging average;

detecting, by the processor, a shift where the difference between the leading average and the lagging average is greater than a predetermined threshold;

sending, by the processor, a signal to the production system regarding the shift; and applying, by the processor, the offset to the data obtained from the pump.

2. The computer-implemented method of claim 1 further comprises validating, by the processor, the detection of the shift.

3. The computer-implemented method of claim 2, wherein the shift is validated where the difference between the leading average and the lagging average of at least one of a tubing head pressure, a drive frequency, or a volts/hertz is greater than the predetermined threshold at any point between a first state and a second state.

4. The computer-implemented method of claim 2, wherein the shift is indicative of a pump off and is validated by movement from a stable state to an out of shift state.

5. The computer-implemented method of claim 1 further comprises reporting, by the processor, the detected shift to a user.

6. The computer-implemented method of claim 1, wherein the data stream is at least one of: differential tubing pressure, drive frequency, tubing head pressure, or a volts to hertz ratio.

7. An apparatus, comprising:

at least one processing unit; and program code configured upon execution by the at least one processing unit to monitor an electric submersible pump and detect a shift by:

obtaining, from an oil and gas production system, a data stream;

determining a leading and a lagging average over a predetermined period of time for the data stream;

determining a difference between the leading average and the lagging average;

determining an offset based on the difference between the leading average and the lagging average;

detecting a shift where the difference between the leading average and the lagging average is greater than a predetermined threshold;

sending a signal to the production system regarding the shift;

applying the offset to the data obtained from the pump; and validating the detection of the shift.

8. The apparatus of claim 7, wherein the shift is validated where the difference between the leading average and the lagging average of at least one of a tubing head pressure, a drive frequency, or a volts/hertz is greater than the predetermined threshold at any point between a first state and a second state.

9. The apparatus of claim 7, wherein the shift is indicative of a pump off and is validated by movement from a stable state to an out of shift state.

10. The apparatus of claim 7, wherein the program code is further configured to report the detected shift to a user.

11. The apparatus of claim 7, wherein the data stream is at least one of: differential tubing pressure, drive frequency, tubing head pressure, or a volts to hertz ratio.

12. A program product, comprising:

a computer readable medium; and program code stored on the computer readable medium and configured upon execution by at least one processing unit to perform electric submersible pump monitoring and shift detection by:

obtaining, from an oil and gas production system, a data stream;

determining a leading and a lagging average over a predetermined period of time for the data stream;

determining a difference between the leading average and the lagging average;

determining an offset based on the difference between the leading average and the lagging average;

detecting a shift where the difference between the leading average and the lagging average is greater than a predetermined threshold;

sending a signal to the production system regarding the shift;

applying the offset to the data obtained from the pump; and validating the detection of the shift.

13. The program product of claim 12, wherein the shift is validated where the difference between the leading average and the lagging average of at least one of a tubing head pressure, a drive frequency, or a volts/hertz is greater than the predetermined threshold at any point between a first state and a second state.

14. The program product of claim 13, wherein the shift is indicative of a pump off and is validated by movement from a stable state to an out of shift state.

15. The program product of claim 12, wherein the program code is further configured to report the detected shift to a user.

* * * * *